US005605511A

United States Patent [19]

Schmidt et al.

[11] Patent Number: 5,605,511

[45] **Date of Patent: *Feb. 25, 1997**

[54] GOLF CLUB HEAD WITH AUDIBLE VIBRATION ATTENUATION

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The term of this patent shall not extend beyond the expiration date of Pat. No. 5,301,946.

[21] Appl. No.: 350,335

[22] Filed: Dec. 6, 1994

Related U.S. Application Data

[63] Continuation of Ser. No. 119,622, Sep. 13, 1993, Pat. No. 5,395,114, which is a continuation-in-part of Ser. No. 999, 250, Jan. 19, 1993, Pat. No. 5,301,946, which is a continuation-in-part of Ser. No. 921,857, Aug. 5, 1992, Pat. No. 5,282,625.

[51] Int. Cl.[6] ..... A63B 53/04

[52] U.S. Cl. ..... 473/324; 473/329; 473/332; 473/345

[58] Field of Search ..... 273/169, 78, 167 H, 273/167 F; 473/430, 329, 332, 341, 347, 348, 349, 350, 334

[56] References Cited

U.S. PATENT DOCUMENTS

| | | | |
|---|---|---|---|
| D. 228,355 | 9/1973 | Penna | 473/324 |
| D. 234,963 | 4/1975 | Hirata | 473/324 |
| D. 247,383 | 2/1978 | Adkins | 473/324 |

(List continued on next page.)

FOREIGN PATENT DOCUMENTS

| | | | |
|---|---|---|---|
| 901416 | 4/1985 | Belgium | 473/324 |
| 582366 | 4/1993 | European Pat. Off. | 473/324 |
| 608128 | 1/1994 | European Pat. Off. | 473/324 |
| 2575393 | 7/1986 | France | 473/324 |
| 2680695 | 9/1993 | France | 473/324 |
| 5315412 | 5/1978 | Japan | 473/324 |
| 5554634 | 4/1980 | Japan | 473/324 |
| 58-166365 | 10/1983 | Japan | 473/324 |
| 60-147451 | 8/1985 | Japan | 473/324 |
| 62-233176 | 10/1987 | Japan | 473/324 |
| 6319168 | 1/1988 | Japan | 473/324 |
| 63-267376 | 11/1988 | Japan | 473/324 |
| 268078 | 3/1990 | Japan | 473/324 |
| 37178 | 1/1991 | Japan | 473/324 |
| 371974 | 5/1932 | United Kingdom | 473/324 |
| 2165461 | 4/1986 | United Kingdom | 473/324 |

OTHER PUBLICATIONS

Golf Digest Annual 1978, Feb., 1978, p. 22, "Reflex".
"Some of Our Best Friends are Hookers and Pushers", Golf World, Jan. 1974, p. 45.
"The Ounce That Counts", Golf World, Jan. 24, 1975, pp. 46 & 47.
"Stroke–Savers", Golf Digest, Mar. 1988, pp. 82 & 83.
"FTD Iron by First Flight", Golf World, May 23, 1972, p. 10.
PCT International Publication WO 85/01220 dated Mar. 28, 1985.
French International Publication WO 93/20904, published Oct. 28, 1993.

*Primary Examiner*—V. Millin
*Assistant Examiner*—Charles W. Anderson
*Attorney, Agent, or Firm*—William W. Haefliger

[57] ABSTRACT

A golf club head having a body defining a heel, toe, top wall, sole defining a bottom wall, and a front wall defining an upwardly and rearwardly inclined front face, and comprising the body defining a forwardly extending main recess located rearwardly of the front wall; and the body also defining an undercut recess located directly rearwardly of the front wall and extending outwardly from the main recess toward one or more of the following:

i) the top wall ii) the bottom wall iii) the toe iv) the heel;

and structure on said front wall and located forwardly of the main recess for attenuating audible vibration created when a golf ball is struck by the front face.

30 Claims, 2 Drawing Sheets

U.S. PATENT DOCUMENTS

| | | | |
|---|---|---|---|
| D. 303,132 | 8/1989 | Muta | 473/324 |
| D. 321,920 | 11/1991 | Parente et al. | 473/324 |
| 1,485,685 | 3/1924 | McMahon | 473/324 |
| 1,517,476 | 12/1924 | Tyler | 473/324 |
| 1,854,548 | 4/1932 | Hunt | 473/324 |
| 1,894,706 | 1/1933 | Reach | 473/324 |
| 1,906,239 | 5/1933 | Reach | 473/324 |
| 1,946,007 | 2/1934 | Watson | 473/324 |
| 1,953,604 | 4/1934 | Heller | 473/324 |
| 1,980,408 | 11/1934 | Jansky | 473/324 |
| 1,984,707 | 1/1934 | Reach | 473/324 |
| 1,993,928 | 3/1935 | Glover | 473/324 |
| 2,129,068 | 9/1938 | Reach | 473/324 |
| 2,231,847 | 2/1941 | Dickson et al. | 473/324 |
| 2,846,228 | 8/1958 | Reach | 473/324 |
| 3,068,011 | 12/1962 | Sano | 473/324 |
| 3,079,157 | 2/1963 | Turner | 473/324 |
| 3,199,872 | 8/1965 | Taylor | 473/324 |
| 3,537,717 | 11/1970 | Caldwell | 473/324 |
| 3,640,836 | 2/1972 | Oberst et al. | 473/324 |
| 3,674,624 | 7/1972 | Oberst et al. | 473/324 |
| 3,674,625 | 7/1972 | Oberst et al. | 473/324 |
| 3,833,404 | 9/1974 | Sperling et al. | 473/324 |
| 3,841,641 | 10/1974 | Bennett | 473/324 |
| 3,847,399 | 11/1974 | Raymont | 473/324 |
| 3,863,932 | 2/1975 | Lezatte | 473/324 |
| 3,923,308 | 12/1975 | Mills | 473/324 |
| 3,967,826 | 7/1976 | Judice | 473/324 |
| 3,989,248 | 11/1976 | Campau | 473/324 |
| 4,043,562 | 8/1977 | Shillington | 473/324 |
| 4,113,249 | 9/1978 | Beery | 473/324 |
| 4,199,144 | 4/1980 | Skelly | 473/324 |
| 4,220,336 | 9/1980 | Kochevar | 473/324 |
| 4,223,073 | 9/1980 | Caldwell et al. | 473/324 |
| 4,272,572 | 6/1981 | Netherly | 473/324 |
| 4,398,965 | 8/1983 | Campau | 473/324 |
| 4,405,149 | 9/1983 | Piegay | 473/324 |
| 4,408,238 | 10/1983 | Hearn | 473/324 |
| 4,438,946 | 3/1984 | Piegay | 473/324 |
| 4,447,493 | 5/1984 | Driscoll et al. | 473/324 |
| 4,498,672 | 2/1985 | Bulla | 473/324 |
| 4,516,778 | 5/1985 | Cleveland | 473/324 |
| 4,573,685 | 3/1986 | Young, IV et al. | 473/324 |
| 4,621,808 | 11/1986 | Orchard et al. | 473/324 |
| 4,627,635 | 12/1986 | Koleda | 473/324 |
| 4,632,400 | 12/1986 | Boone | 473/324 |
| 4,653,756 | 3/1987 | Sato | 473/324 |
| 4,660,832 | 4/1987 | Shomo | 473/324 |
| 4,681,816 | 7/1987 | Hashimoto et al. | 473/324 |
| 4,715,601 | 12/1987 | Lamanna | 473/324 |
| 4,736,949 | 4/1988 | Muroi | 473/324 |
| 4,740,345 | 4/1988 | Nagasaki et al. | 473/324 |
| 4,760,478 | 7/1988 | Pal et al. | 473/324 |
| 4,792,139 | 12/1988 | Nagasaki et al. | 473/324 |
| 4,798,383 | 1/1989 | Nagasaki et al. | 473/324 |
| 4,811,950 | 3/1989 | Kobayashi | 473/324 |
| 4,848,747 | 7/1989 | Fujimura et al. | 473/324 |
| 4,854,581 | 8/1989 | Long | 473/324 |
| 4,865,345 | 9/1989 | Piegay | 473/324 |
| 4,875,679 | 10/1989 | Movilliat et al. | 473/324 |
| 4,884,812 | 12/1989 | Nagasaki et al. | 473/324 |
| 4,909,511 | 3/1990 | Deville et al. | 473/324 |
| 4,913,435 | 4/1990 | Kobayashi | 473/324 |
| 4,928,972 | 5/1990 | Nakanishi et al. | 473/324 |
| 4,957,294 | 9/1990 | Long | 473/324 |
| 4,964,640 | 10/1990 | Nakanishi et al. | 473/324 |
| 4,986,541 | 1/1991 | Teramoto et al. | 473/324 |
| 4,993,711 | 2/1991 | Deville et al. | 473/324 |
| 4,995,609 | 2/1991 | Parente et al. | 473/324 |
| 4,995,630 | 2/1991 | Piegay | 473/324 |
| 5,026,056 | 6/1991 | McNally et al. | 473/324 |
| 5,046,733 | 9/1991 | Antonious | 473/324 |
| 5,067,711 | 11/1991 | Parente et al. | 473/324 |
| 5,082,279 | 1/1992 | Hull et al. | 473/324 |
| 5,083,778 | 1/1992 | Douglass | 473/324 |
| 5,118,562 | 6/1992 | Johnson et al. | 473/324 |
| 5,127,653 | 7/1992 | Nelson | 473/324 |
| 5,176,384 | 1/1993 | Sata et al. | 473/324 |
| 5,226,651 | 7/1993 | du Gardin | 473/324 |
| 5,277,423 | 1/1994 | Artus | 473/324 |
| 5,282,625 | 2/1994 | Schmidt et al. | 473/324 |
| 5,290,036 | 3/1994 | Fenton et al. | 473/324 |
| 5,299,807 | 4/1994 | Hutin | 473/324 |
| 5,301,946 | 4/1994 | Schmidt et al. | 473/324 |
| 5,316,298 | 5/1994 | Hutin et al. | 473/324 |

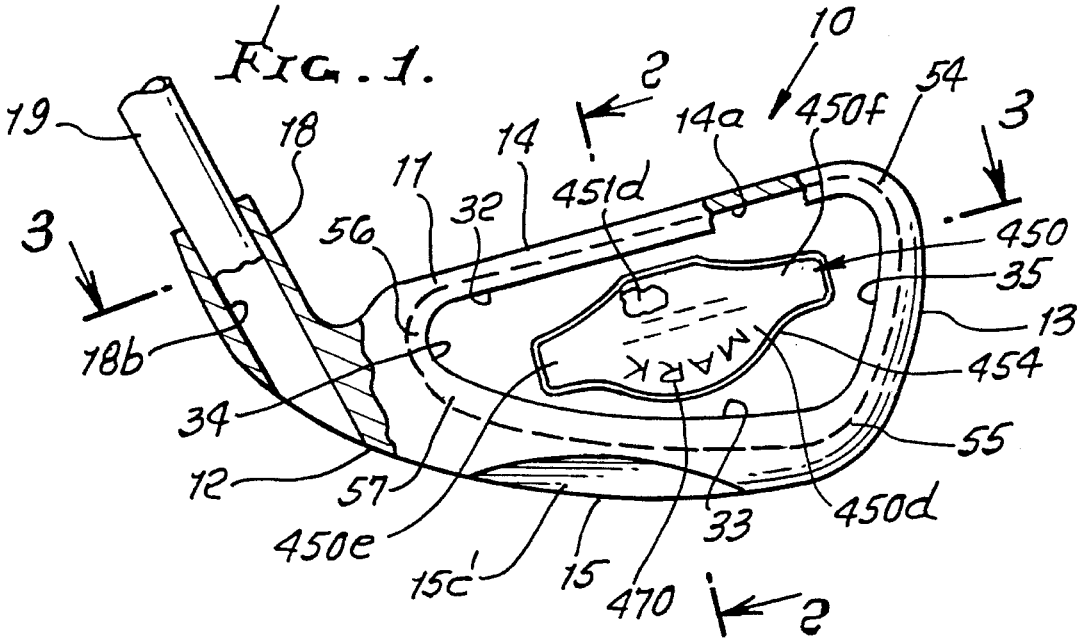
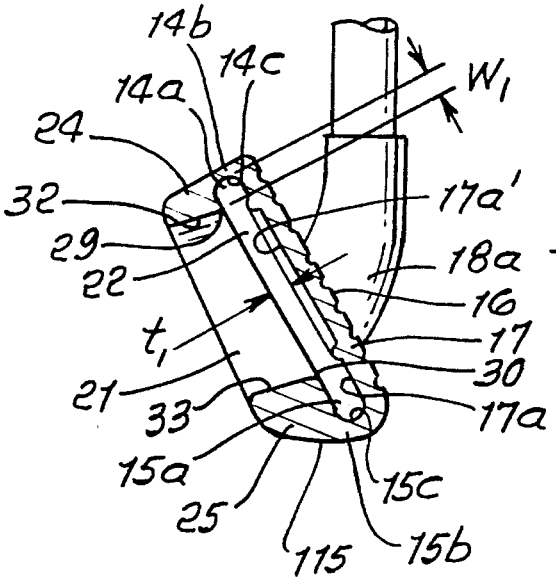
FIG. 2.
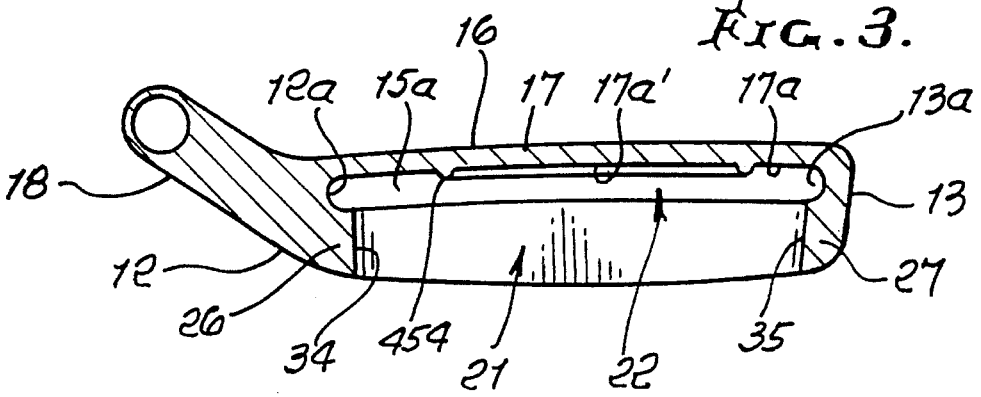
FIG. 3.

10
18
18a
14
16
13

22
454
17
17a'
450
451
454
17a

17a'
17
451a
470a
451c
450
451b

GOLF CLUB HEAD WITH AUDIBLE VIBRATION ATTENUATION

This is a continuation of application Ser. No. 08/119,622 filed Sep. 13, 1993 now U.S. Pat. No. 5,395,114; which is a continuation-in-part of Ser. No. 07/999,250 filed Jan. 19, 1993 now U.S. Pat. No. 5,301,946 issued Apr. 12, 1994; which is a continuation-in-part of Ser. No. 07/921,857 filed Aug. 15, 1992 now U.S. Pat. No. 5,282,625 issued Feb. 1, 1994.

BACKGROUND OF THE INVENTION

This invention relates generally to golf clubs, and more particularly to golf club irons of improved construction to achieve advantages, such as audible sound attenuation, twist resistance, during impact with golf balls, and delayed momentum transfer to golf balls during stroking. In this regard, and in the past, irons evolved in design from flat back to hollow back structure, the present invention providing a further evolution in back structure to achieve virtual head enlargement effects, and attenuation of audible sound created during impact with a golf ball.

Many efforts have been made to design iron heads to achieve higher energy availability for transfer to the golf ball when the ball is impacted by the head. However, no way was known, to our knowledge, to achieve delayed momentum transfer to the ball, over the very short time interval when the ball remains in contact with the head face, in the novel and unusual manner as achieved by the present invention; and no way was known to couple such delayed energy transfer with head twist resistance, in the manner to be described.

Also, no way was known to attenuate audible sound created by impact with a golf ball by a front wall that has reduced peripheral rigidity due to weight displacement, as will be described.

SUMMARY OF THE INVENTION

It is a major object of the invention to provide an improved iron head construction meeting the need for delayed momentum transfer to the ball during club stroking, and also to provide for attenuation of audible vibration as well as club head increased twist resistance. Basically, the invention as embodied in a head metallic body, is constructed to define two intersecting recesses rearwardly of the head front wall, and bounded by head metallic extents projecting rearwardly proximate peripheral regions of the head face defining front wall via web means adjacent the head front wall periphery. For example, the head may include:

a) a body defining a forwardly extending main recess located rearwardly of the front wall, b) and the body also defining an undercut recess located directly rearwardly of the front wall and extending outwardly from the main recess toward at least one of the following:
   i) the top wall
   ii) the bottom wall
   iii) the toe
   iv) the heel, c) together with means on the front wall and located forwardly of the main recess for attenuating audible vibration created when a golf ball is struck by the front face.

As will be seen, the attenuation means may include a thin plate, and adhesive material securing the plate to the rear side of the front wall. The front wall rear side may be recessed to receive and confine the plate and adhesive. Further, the undercut recess may extend outwardly from its intersection with the main recess and away from the attenuation plate periphery toward both of the top and bottom walls, and toward the toe and heel, whereby the undercut recess may then bound the main recess. This construction also facilitates slightly delayed forward transfer of momentum of the body metal rearwardly of the undercut recess, to the front wall and front face, via peripheral extents of the head. Such peripheral extents may be localized due to provision of slits, as will appear.

Typically, the metal of the head has reduced thickness to form webs directly rearwardly of the front wall periphery, due to the provision of the undercut recess, as referred to. Thus, the undercut recess typically extends upwardly to points along the head length rearwardly of the top of the front wall front face, and downwardly to points along the head length rearwardly of the bottom of the front wall front face. This also enables reallocation of some metal to project rearwardly from the looping recess, enhancing head peripheral weighting for anti-twist effect; and any tendency of the front wall to create sound may be partly and significantly reduced due to provision of the attenuation means.

Another objective is to provide an undercut recess, as referred to, which extends in a loop that lies generally parallel to the inclined front face of the iron. The slits, as referred to, extend toward that loop, the inclination of which varies with the number of the iron, designating different front face inclinations, as for example 1 to 9 irons and wedges.

A further object is to provide the head with a rearward projection with upward thickening between the bottom wall and the main recess, and rearwardly of the undercut recess that extends toward the bottom wall; and the head may also have a rearward projection with downward thickening between the top wall and the main recess, and rearwardly of the undercut recess that extends toward the top wall.

Yet another object is to provide a set of irons, each iron incorporating the dual intersecting recesses, and with audible vibration attenuation, as referred to, and the rearward projections extending generally horizontally irrespective of the angles of the front faces of the irons in the set.

These and other objects and advantages of the invention, as well as the details of illustrative embodiments, will be more fully understood from the following specification and drawings, in which:

DRAWING DESCRIPTION

FIG. 1 is a rear elevation of the head of a #6 iron of a golf club set incorporating the invention;

FIG. 2 is a section taken on lines 2—2 of FIG. 1;

FIG. 3 is a section taken on lines 3—3 of FIG. 1;

DETAILED DESCRIPTION

Figure 4:
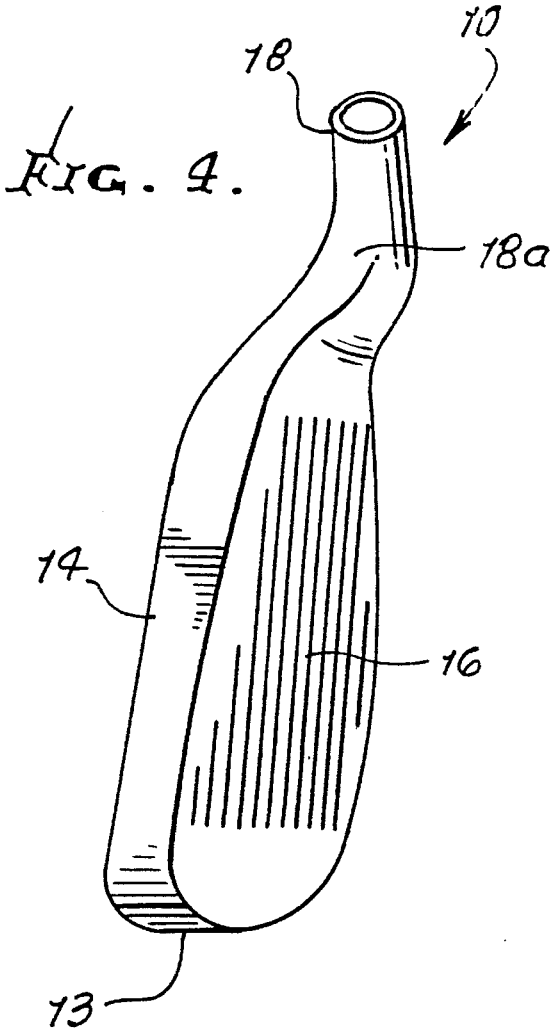
FIG. 4 is a top plan of the FIG. 1 head.
Figure 5:
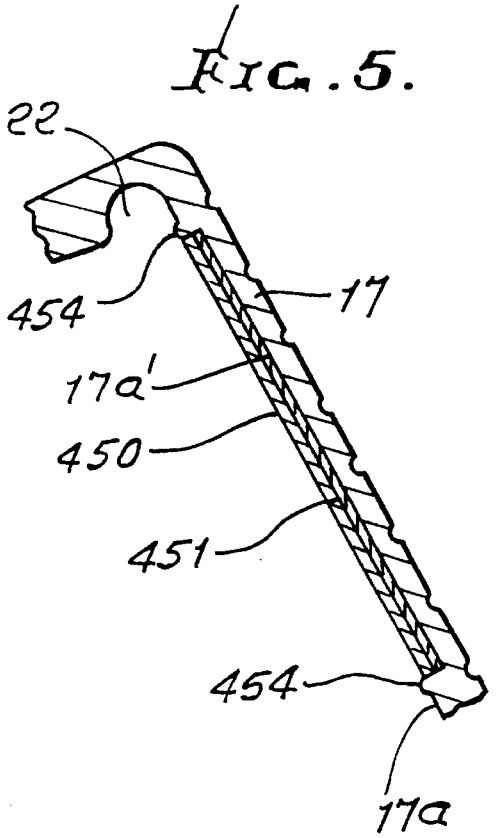
FIG. 5 is an enlarged, fragmentary vertical section similar to FIG. 2.

Referring first to FIGS. 1–3, the illustrated golf club head 10, in the form of a #6 iron of a set, has a body 11 defining a heel 12, toe 13, top wall 14, and sole 15. The rear of the sole is beveled at 15*c*, as shown. The body also defines an upwardly and rearwardly inclined front face 16 at the frontal side of an associated front wall 17. A hosel is shown at 18 and integrally joins the head via offset 18*a*; and a shaft 19 extends into a through bore 18*b* in the hosel as shown, and is anchored therein in a suitable manner, as for example by adhesive or mechanically. See for example U.S. Pat. No. 5,042,806, incorporated herein by reference. The head and hosel may consist of a one-piece, metallic steel casting, other metals and alloys being usable.

The body defines two intersecting recesses related to rearwardly elongated body projections, typically extending rearwardly, as will be described, irrespective of the head front face angularity. The two recesses include a forwardly and rearwardly extending main recess 21, and an undercut recess 22 located directly rearwardly of the front wall and extending outwardly from the forwardmost extent of the main recess 21, toward at least three of the following:

i) top wall 14 ii) bottom wall or sole 15 iii) the toe region 13 iv) the heel region 12.

Typically, the undercut recess portions 14*a* and 15*a*, associated with walls 14 and 15, are elongated directionally between the toe and heel, over the major length of the head, thereby enhancing the benefits which include metal redistribution toward the upper and lower peripheries of the head, and projecting rearwardly at 24 and 25, for enhancing anti-twist of the head during stroking and ball impact. Such metal rearwardly redistribution, i.e., lengthening in a rearwardly and functionally outwardly (enlarging effect) direction, as at 24 and 25, rearwardly of undercuts 14*a* and 15*a*, is believed to achieve somewhat delayed momentum transfer from the metal portions 24 and 25, to the front wall and front face 16, thereby maintaining a greater time interval of front face contact with the ball during stroking, for better ball control.

This effect may be further enhanced by the provision of at least one elongated slit extending generally parallel to the front face 16 and spaced rearwardly from that face 16, to intersect undercut 14*a* and the upper surface of 24.

Note that such momentum transfer, visualized in the form of forward waves, is required to pass around and through the reduced thickness forward portions 14*b* and 15*b* of the rearwardly projecting portions 24 and 25, and at the corners 54 and 55, as well as at regions 56 and 57 near the heel; and delay of momentum or inertia travel through such restricted, narrowed regions 14*b* and 15*b*, and at 54–57, is facilitated by the outwardly concave curvature at 14*c* and 15*c*, or other similar thickness narrowing shape, bounding the outermost extents of the undercuts 14*a* and 15*a*. Enhanced performance is thereby achieved in terms of better ball stroking and directional control, through delayed momentum transfer to the struck ball.

The undercut recess portions 12*a* and 13*a*, associated with the heel and toe, and associated metal redistribution rearwardly and functionally outwardly (i.e., enlarging effect) from those undercuts, at corners 54–57, contribute to and add to the same effects as described above for the undercut recess portions 14*a* and 15*a* at those corners. The undercut recess projects outwardly to an extent $w_1$ (which may vary, as shown); however, the front-to-rear thickness $t_1$ of the undercut recess is approximately as follows:

$$0.5t_1<w_1<1.5t_1$$

The radii of the circular curvatures at 14*c* and 15*c* are typically between 0.150 and 0.160 inches for #1 through #7 irons; between 0.210 and 0.230 for #8 and #9 irons; and between 0.300 and 0.320 for a pitching wedge; however, these dimensions can vary somewhat.

In this regard, the rearward projections extending rearwardly from the toe and heel undercuts are rearwardly elongated in relation to their thickness dimensions, showing that metal has been redistributed to those projections to enhance the effects described and without increasing the overall vertical dimension of the head.

Note also that the dimension of the recess 21, between internal corners 29 and 30, is at least about three times greater than the depth dimension of each of the undercut recess portions 14*a* and 15*a*, in an outward direction from those corners. The inner sides 32 and 33 of the projections 24 and 25 are substantially flat in a forward to rearward direction; however, they define a loop in combination with the corresponding inner and curved sides 34 and 35 of the projections 26 and 27, that loop subtending the major aerial extent of the front face, including a "sweet spot". Correspondingly, all undercut sections 14*a* and 15*a*, 12*a* and 15*a*, also define, preferably, a loop.

It will be understood that #1–5 and #7–9 irons have the same construction, but with associated changing front face inclinations, as in a set of such irons. Accordingly, each iron of the set has the invention incorporated therein.

Referring now to FIGS. 1, 2, 4, and 5, means is provided on the front wall 17 and located forwardly of the main recess 21 for attenuating audible vibration created when a golf ball is struck by the front face.

Figure 6:
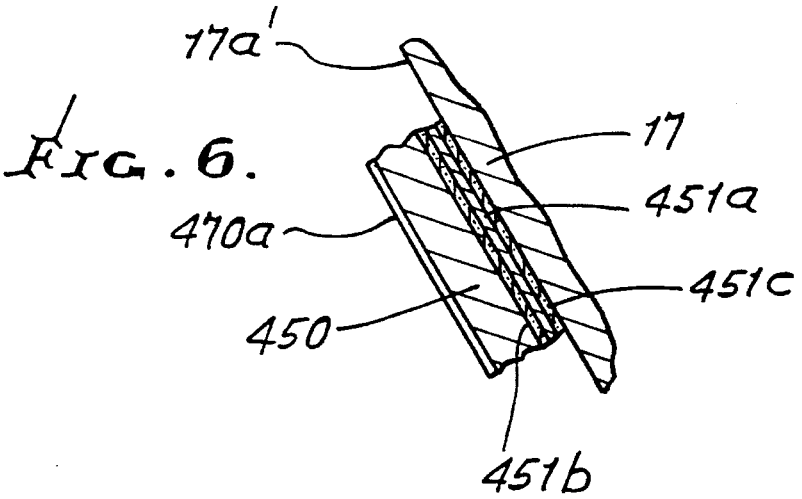
FIG. 6 is a still further enlarged, vertical section taken through a thin plate and adhesive means thereon, for use on the head.

Such means is typically attached to the rear side 17*a* of the front wall and is openly exposed to both recesses 21 and 22, the undercut recess extending about and spaced from the attenuation means. The latter is shown, for example, in the form of a thin plate (see also FIG. 4) 450 with a thin layer 451 of adhesive material adhering the thin plate to the rear side 17*a* of the front wall. As seen in FIG. 6, such material may take the form of a tape 451*a* having adhesive layers 451*b* and 451*c* at its opposite sides, to secure to the plate and also to the rear side 17*a* of the front wall.

The front wall rear side is shown as forming a shallow re-entrant recess 17*a'* receiving and peripherally confining the tape and plate. See also ridge 454 on the front wall rear side adjacent the tape and plate peripheral configurations and projecting rearwardly. The latter include like medial planar medial portions 450*d* and 451*d*, and two tape wings 450*e* and 450*f* projecting in opposite directions, i.e., toward the heel and toe, respectively, as well as corresponding adhesive wings 451*e* and 451*f*. The entirety of the plate and adhesive material are effectively in the plane of the rear side of the front wall of the head, to vibrate therewith, front to rear, and to dampen or attenuate front wall vibration. The rearward projection of the plate defines an area between 25% and 75% of the cross sectional area of the recess 21, in planes parallel to the plane of the thin plate. Also, the plate area is between 20% and 65% of the area of the rear side of the front plate subtended by both recesses 21 and 22.

The plate 450 is typically metallic and may consist of aluminum, with thickness between 0.02 and 0.05 inches, and total area between 0.35 and 0.75 square inches. The tape 451*a* may consist of paper, and the adhesives 451*b* and 451*c* may consist of epoxy resins.

Indicia 470 may be employed on the plate, to be observed via recess 21. Such indicia may be on a decal 470*a* adhered to the plate (see FIG. 6).

We claim:

1. A golf club head having a body defining a heel, toe, top wall, sole defining a bottom wall, and a front wall defining an upwardly and rearwardly inclined front face, and comprising a) said body defining a forwardly extending main recess located rearwardly of said front wall, b) and said body also defining an undercut recess located directly rearwardly of said front wall and extending outwardly from said main recess toward at least one the following:

i) said top wall ii) said bottom wall iii) said toe iv) said heel, c) and means on said body and openly exposed to said undercut recess for attenuating audible vibration created when a golf ball is struck by said front face.

2. The combination of claim 1 wherein said front wall has a rear side and said means is bonded to said rear side and openly exposed to said recess.

3. The combination of claim 2 wherein said means include a thin plate and adhesive material securing said plate to said rear side of the front wall, and in spaced relation to said undercut recess.

4. The combination of claim 3 wherein said thin plate has a periphery, and said front wall has a shallow re-entrant recess at said rear side receiving said plate, closely adjacent said periphery.

5. The combination of claim 3 wherein said thin plate has an enlarged central portion and two wings projecting oppositely generally toward the toe and heel respectively of the head.

6. The golf club head of claim 3 wherein said means includes a tape, with said adhesive material at opposite sides of the tape to adhere to the thin plate and to adhere to said rear side of the front wall.

7. The golf club head of claim 3 including a re-entrant recess in said rear side of the front wall, the recess and said plate and tape having corresponding peripheries.

8. The golf club head of claim 7 including a ridge on said rear side of the front wall and projecting rearwardly at said periphery of the recess.

9. The golf club head of claim 7 wherein the thin plate and tape define a medial enlarged portion, and wing portions projecting oppositely from said medial portions and toward the head, toe, and heel, respectively, the plate being metallic.

10. The golf club head of claim 7 including indicia on the plate and facing said main recess.

11. The combination of claim 1 wherein said undercut recess extends about said means in spaced relation thereto.

12. The combination of claim 1 wherein said means includes a thin plate and adhesive material securing said plate to said body.

13. The golf club head of claim 12 wherein said undercut recess extends outwardly from said main recess and adjacent said front wall in spaced relation to said thin plate toward at least two the following:

i) said top wall ii) said bottom wall iii) said toe iv) said heel.

14. The club head of claim 12 wherein said undercut recess extends outwardly from said main recess and adjacent said front wall in spaced relation to said thin plate toward at least three of the following:

i) said top wall ii) said bottom wall iii) said toe iv) said heel.

15. The golf club head of claim 12 wherein said undercut recess extends outwardly from said main recess and in spaced relation to said thin plate toward all four of the following:

i) said top wall ii) said bottom wall iii) said toe iv) said heel.

16. The golf club head of claim 15 wherein said undercut recess extends outwardly toward said top wall and toward said bottom wall, the depth of the undercut recess toward said top wall being lesser than the depth of said undercut recess toward said bottom wall.

17. The golf club head of claim 16 wherein said undercut recess toward said top wall has a substantially circular cross section adjacent said top wall, and said undercut recess toward said bottom wall has a substantially circular cross section adjacent said bottom wall, and rearward of the uppermost level of said front wall.

18. The golf club head of claim 16 wherein said undercut recess proximate said heel and proximate the toe decreases gradually in depth in an upward direction.

19. The golf club head of claim 15 wherein said undercut recess extends in a loop that is generally parallel to the inclined front face.

20. The combination of claim 12 wherein said thin plate defines an area between 20% and 65% of the area of the rear side of the front plate subtended by both said main and undercut recesses.

21. The golf club head of claim 1 wherein said body has at least one elongated slit therein extending generally parallel to the front face and spaced rearwardly therefrom, the slit intersecting an outer surface defined by the body.

22. The golf club head of claim 1 wherein said head has rearward projection with upward thickening between said bottom wall and said main recess, and rearwardly of said undercut recess that extends toward said bottom wall.

23. The golf club head of claim 22 wherein said head has rearward projection with downward thickening between said top wall and said main recess, and rearwardly of said undercut recess that extends toward said top wall.

24. The golf club head of claim 22 wherein said body is a one-piece casting, and defines an iron golf club head.

25. The golf club head of claim 22 wherein said rearward projection from the undercut recess has substantially greater overall rearward dimension than vertical thickness dimension.

26. The golf club head of claim 1 wherein said head has rearward projection with downward thickening between said top wall and said main recess, and rearwardly of said undercut recess that extends toward said top wall.

27. The golf club head of claim 26 wherein said rearward projection from the undercut recess has substantially greater overall rearward dimension than vertical thickness dimension.

28. The golf club head of claim 1 said body is metallic.

29. The golf club of claim 1 wherein said body consists of a metallic casting.

30. The golf club head of claim 1 wherein said undercut recess projects outwardly to an extent $w_1$, and has front to rear thickness $t_1$, where $0.5t_1<w_1<1.5_t$.

* * * * *